US005209484A

United States Patent [19]

Randall

[11] Patent Number: 5,209,484

[45] Date of Patent: May 11, 1993

[54] GOLF PUTTING IMPROVEMENT AND TEACHING APPARATUS AND METHOD

[76] Inventor: Charles R. Randall, 283 W. Lake Samish Dr., Bellingham, Wash. 98225

[21] Appl. No.: 794,725

[22] Filed: Nov. 14, 1991

[51] Int. Cl.[5] ..... A63B 69/36

[52] U.S. Cl. ..... 273/192; 273/187.6; 273/179 R; 273/176 F

[58] Field of Search ..... 273/192, 177 R, 187.6, 273/179 R, 187.6, 183.1, 177 B, 191 R, 176 F, 176 FB

[56] References Cited

U.S. PATENT DOCUMENTS 2,592,713 4/1952 Koch et al. ..... 273/177 R
2,894,755 7/1959 Scelzo ..... 273/192
4,230,319 10/1980 Lindner ..... 273/192
4,423,875 1/1984 Miller ..... 273/192
4,886,274 12/1989 Park ..... 273/176 FB

*Primary Examiner*—George J. Marlo
*Attorney, Agent, or Firm*—Hughes & Multer

[57] ABSTRACT

A golf putting practice apparatus comprising a rectangular frame defining a putting area. A rebound member is located at one end of the putting area, and a locating cord with three locating beads moveably mounted thereon extends between the ends of the frame. A putting stroke is established by setting the locating beads at designated locations to define the limits of the backstroke and follow through, as well as the position of the ball. Alignment locating clips are provided.

24 Claims, 6 Drawing Sheets 26
32
22
24
28
30
44b
10
42
48
24
44a
44c
54
48
26
12
20
14
18
16
38
10
54
46
32
36

GOLF PUTTING IMPROVEMENT AND TEACHING APPARATUS AND METHOD

BACKGROUND OF THE INVENTION

1. Field of the Invention

The present invention relates to an apparatus and method for improving a person's putting for golf, and also for teaching the person proper putting techniques.

2. Background Art

There are various devices in the prior art to improve the ability of a person to putt a golf ball properly, and many of these provide means for proper alignment of the putting stroke. However, the mechanics of properly putting a golf ball involve a number of factors, all of which must be taken into consideration to have an accurate and proper putting stroke. While many of these prior art devices do deal with such factors as alignment, to the best knowledge of the applicant herein, such prior art devices do not adequately address all of the main components that must be combined for consistent accurate putting.

SUMMARY OF THE INVENTION

Accordingly, the present invention directed toward and apparatus and method to enable the practice of teaching of all of the basic components necessary to provide a proper putting stroke.

The apparatus of the present invention comprises a frame adapted to be positioned on a putting surface, the frame having side rails and end members defining a putting area and having a longitudinal axis. The head of a putter and a golf ball can be positioned in the putting area with the side rails defining a putting path.

A rebound member is positioned at one end of the frame in transverse alignment with the putting path so as to rebound a ball traveling on the putting path back along the putting path.

In a preferred embodiment, at least one of the end members has a through opening, and the rebound member is removably positioned in alignment with the through opening, whereby the ball in the putting area can, with the rebound member removed, pass through the through opening, or with the rebound member in place, can be rebounded from the through opening. The rebound member comprises in a preferred form a flexible band member extending across the through opening. Also in the preferred embodiment, the two end members are provided one with the rebound member and the other with an unobstructed through opening.

Also in a preferred form, the apparatus comprises a locating means extending along said path and along said longitudinal axis. The locating means is provided with at least two moveable locating members which can be conveniently positioned along the longitudinal axis to identify stroke locations, and more desirably three such members. Desirably, the locating means comprises an elongate mounting member to which the locating members are mounted, and in a preferred form the mounting member comprises a cord means extending between the two end members. The locating members can be made as bead means.

Also a pair of alignment members are mounted to respective rail members, these alignment members being, in a preferred form, a pair of clips.

Further, desirably the rails are adjustably connected to the end members so that the spacing of the rails can be changed.

In the method of the present invention, the person positions the locating members at the desired location to define the location of various portions of the putting stroke. More specifically, one locating member is positioned to locate the backend travel of the backstroke, and a front bead is to locate the forward location of the follow through stroke. Also, a center locating member is used to define the ball location. These can be adjusted to provide different lengths of the stroke components. Further, the alignment clips are moved to position the alignment of the putting head.

The person uses the apparatus in practice by focusing on the locating members and/or alignment members to refine various components of the person's stroke.

DESCRIPTION OF THE PREFERRED EMBODIMENT

Figures 1, 2:
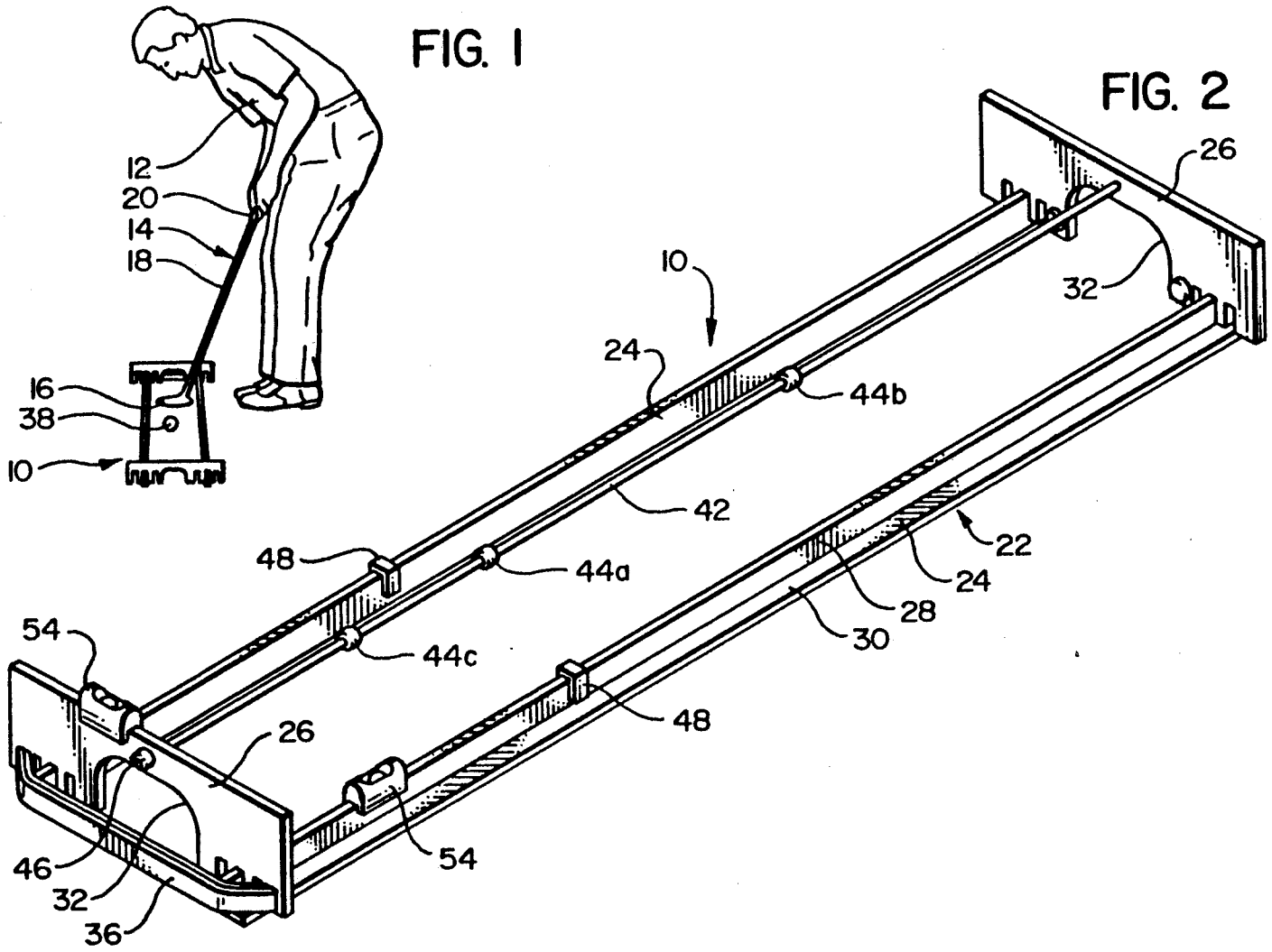
FIG. 1 is an isometric view of a person employing the apparatus of the present invention in practicing the putting stroke.
FIG. 2 is an isometric view of the apparatus of the present invention assembled.
Figure 3:
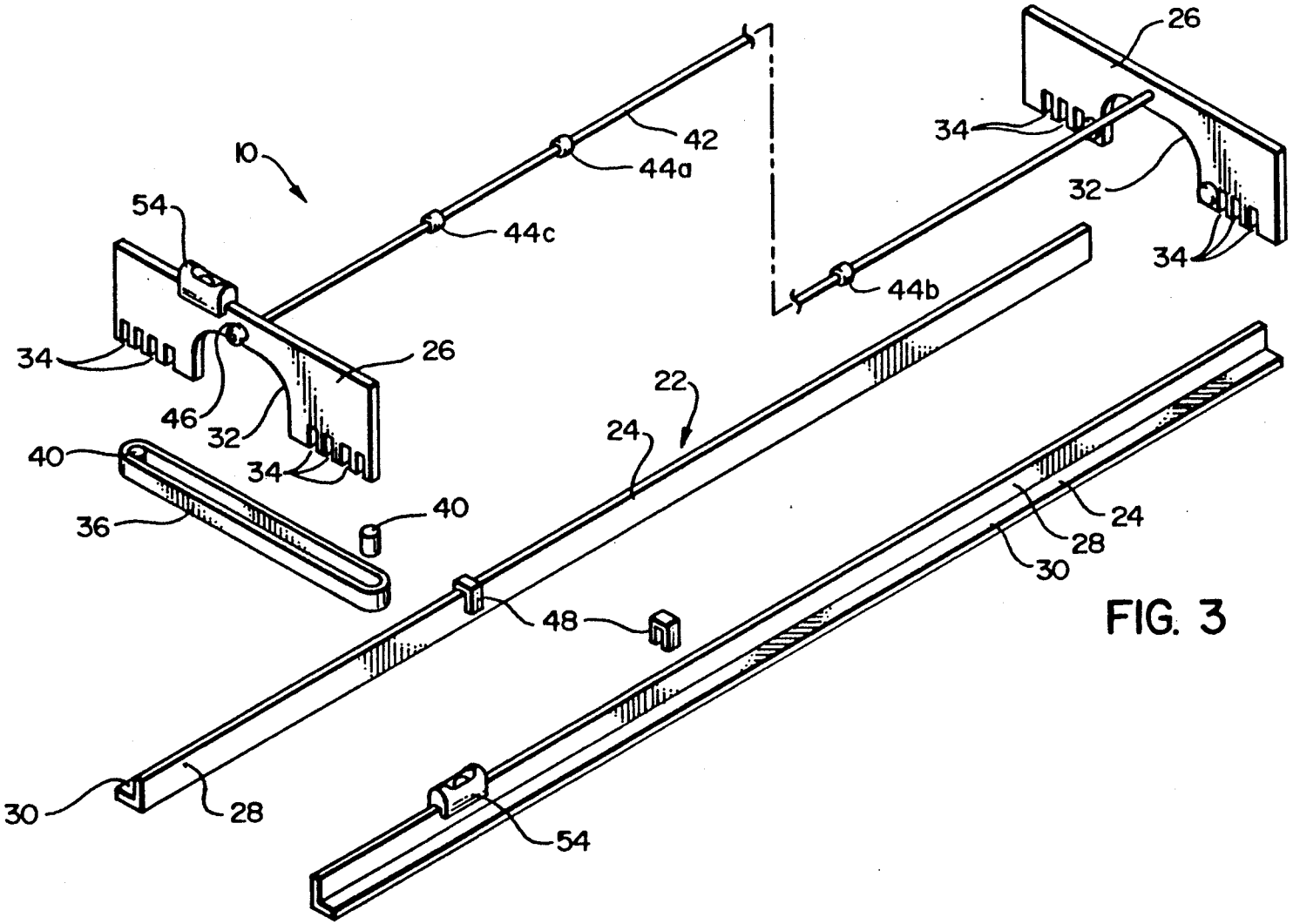
FIG. 3 is an isometric exploded view, showing the components of FIG. 2 separated from one another.

FIG. 1 shows the apparatus 10 of the present invention being used by a person 12 in executing a putting stroke, with the putter 14 having a head 16, a shaft 18 and a handle portion 20.

The present invention comprises both an apparatus, and also the method of using this apparatus in learning or teaching the various components which are generally necessary for executing a proper putting stroke. The apparatus 10 itself will first be described in detail and then the manner in which this is used in the method of the present invention will be disclosed.

This apparatus 10 comprises an enclosure frame 22 made up of two side rails 24 and two end members 26, and having a longitudinal axis 27. As shown herein, the side rails 24 have a right angle cross-sectional configuration, with an upstanding web or flange 28 and a lower horizontal flange or web 30.

Figure 4:
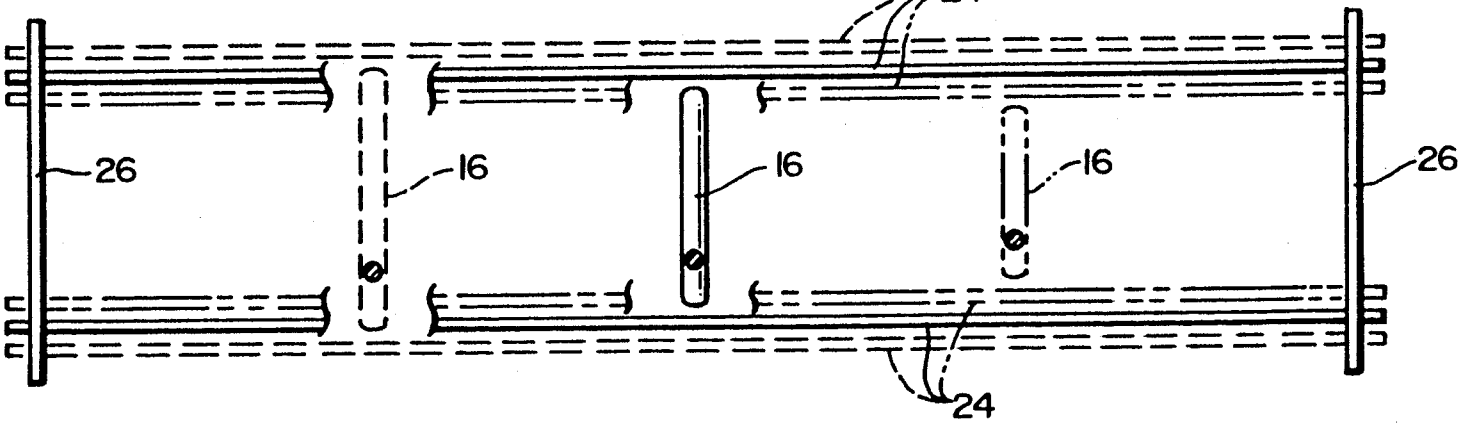
FIG. 4 is a top plan view showing the side rails of the apparatus being at different positions to define different width channels for the putting stroke.

Each end member 26 has the configuration of a flat rectangular plate, with a lower middle cut-out or through opening 32 having a height dimension moderately greater than that of a normal golf ball, and a width dimension possibly two to three times the diameter of a golf ball. So that the two end sections 26 can be adjustably attached to the side rails 24, each side of each end section 26 is provided with a plurality of spaced slots 34 (four in the present embodiment) to receive the flanges 28 of the side members 24. As can be seen in FIG. 4, this permits the side rails 24 to be mounted to the end pieces 26 at various spacing distances to accommodate a putter head 16 of various sizes or to provide more or less room for movement of the putter.

There is also provided an elastic rebound member 36 which is conveniently provided in the form of a rubber band. This rebound member 36 is removably mounted to one of the end members 26 so that it extends across the opening 32 at the mid-height of the golf ball 38 so that when the ball 38 strikes the rebound member 36 it will rebound back toward the player. This band 36 is shown herein to be conveniently mounted by means of two mounting pegs 40 that fit in end loops of the band 36. The two end portions of the band are simply inserted in two of the slots 34 on opposite sides of the end member 26, and the pegs 40 inserted to prevent the end portions of the band 36 from slipping out. Other methods of mounting the band and also of connecting the end members 26 to the rails 24 could be employed. For example, the end members 26 could be provided with outwardly connecting members that would fit in matching slots with the rails 34. Another method would be to use a bolt and wing nut connection and attach the rail members 24 to a slotted connection in the end members 26, as will be described later with reference to FIG. 10. A significant feature of the present invention is the use of a locating cord 42 in conjunction with locating members 44 that can be selectively positioned at various locations along the length of the cord 42. This cord 42 is connected to the end members 26, simply by slipping the cord 42 through holes made at upper central locations of the two members 26 and using a suitable connecting member such as shown at 46.

There are provided two U-shaped locating clips 48 which can be conveniently mounted to the vertical flange members 28 of the two rails 24. As will be disclosed more fully hereinafter, these clips 48 can be positioned at various locations along the rails 24 and serve to provide proper alignment reference of the club head 16 relative to the alignment of the longitudinal axis.

To describe now the operation of the present invention, the apparatus 10 can easily be assembled by mounting the two end sections 26 to the rails 24, with the vertical flanges 28 fitting into the desired set of slots 34. As indicated earlier, the slots 34 can be selected to fit the size of the putting head 16 or also to suit the particular preferences of the person using the apparatus. The locating cord 42 has the two end portions thereof already extending through the end sections 26. If not, then it is a simple matter to insert the ends of the cord 42 through openings in the end sections 26 and then secure these by means of the member 46 or some other means. This locating cord 42 is moderately elastic and is stretched between the end members 26 with a sufficient tension so that it will remain substantially horizontal along the length of the apparatus 10.

As indicated earlier herein, one of the significant features of the present invention is how the apparatus 10 can be utilized in teaching the main components of putting technique which, when incorporated together, make up a proper putting stroke. In general, while the precise grouping or delineation of these components can vary, depending upon the teaching method, these can logically be organized as seven main components. Also, when a person is practicing his (or her) putting stroke and attempting to concentrate on these components, it is advisable that the person's attention be focused on only one of these at a time. After the person becomes sufficiently familiar or comfortable with incorporating one of the components in his golf swing, then the person can fix his attention onto one of the other components. In this manner, the person begins building a coordinated stroke properly incorporating all of these components.

To describe the method of the present invention, let us assume that the apparatus 10 has been assembled, and that the person 12 has taken the stance as shown in FIG. 1. (For ease of illustration, the locating cord 42 has not been shown in FIG. 1).

Figure 5:
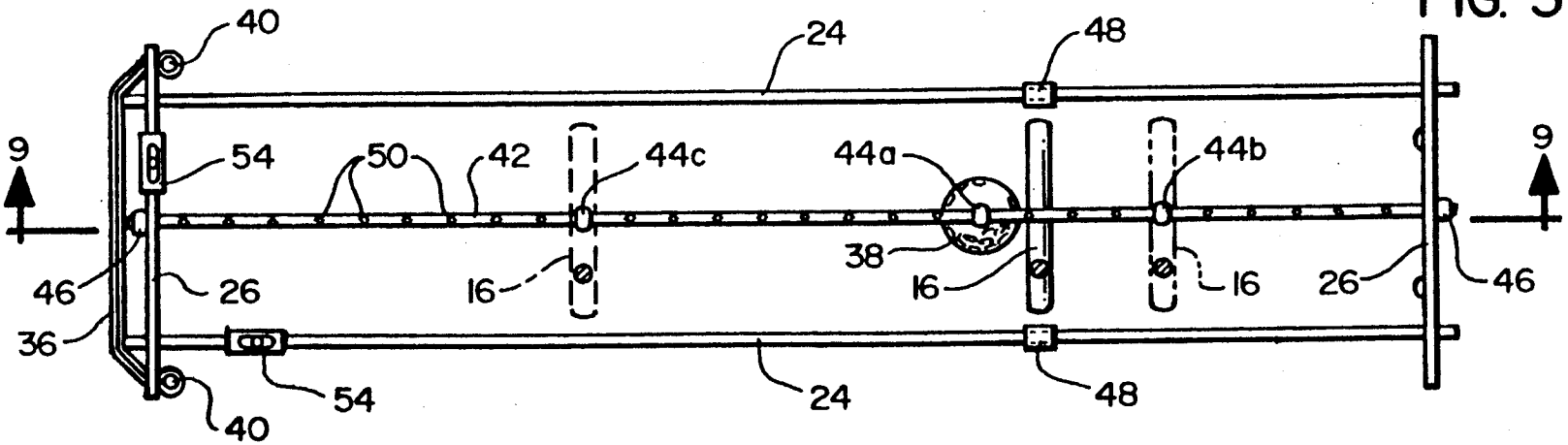
FIG. 5 is a top plan view similar to FIG. 4, showing the positions of the locating beads and alignment clips relative to the golf ball and the club head of the putter being moved to the various locations during the teaching process employed by the present invention.

Step 1: The first step is correct eye alignment to concentrate on the location of the ball. With reference to FIG. 5, the center bead **44*a* is placed at the location where the ball 38 is to be positioned for the putting stroke. The first step in executing a proper putt is to maintain your head steady and your eye on the ball. Locating this middle bead 44*a*** at the location of the ball emphasizes this and gives the person a focal point on which to concentrate.

Step 2: The next step is to keep the person's head still after striking the ball by continuing to concentrate on the middle bead **44*a*. Further, this bead 44*a*** locates the position at which the ball is to be placed.

Step 3: The next step is proper alignment of the club head 16. This is accomplished by placing the two clips 48 at the location where the club head is to be positioned at the start of the putt, which would normally be a very short distance just behind the ball 38. A typical positioning of the club head 16 is shown in FIG. 5.

Step 4: The next step is to move the club head 16 back (while keeping proper alignment) the desired distance, this being dependent in large part on the length of the putt which is being attempted. The second bead **44*b* is positioned on the cord 42 at the rear location where the club head 16 is to be moved at the end of the backstroke. As the person executes the backstroke, the person's eye will be on the rear bead 44*b***.

Step 5: The next step is to carry the club head 16 through the follow through portion of the stroke. The forward bead **44*c* is positioned at the location where the follow through portion of the stroke is to end. Thus, the person executing the putting stroke will move the club head 16 to the location of the forward bead 44*c***.

Step 6: The next step is to ensure that there is proper alignment of the movement of the club head 16 throughout the stroke, and this is accomplished by concentrating in maintaining the club head 16 in alignment with the cord 42 and also by aligning it midway between the two side rails 24.

Figure 9:
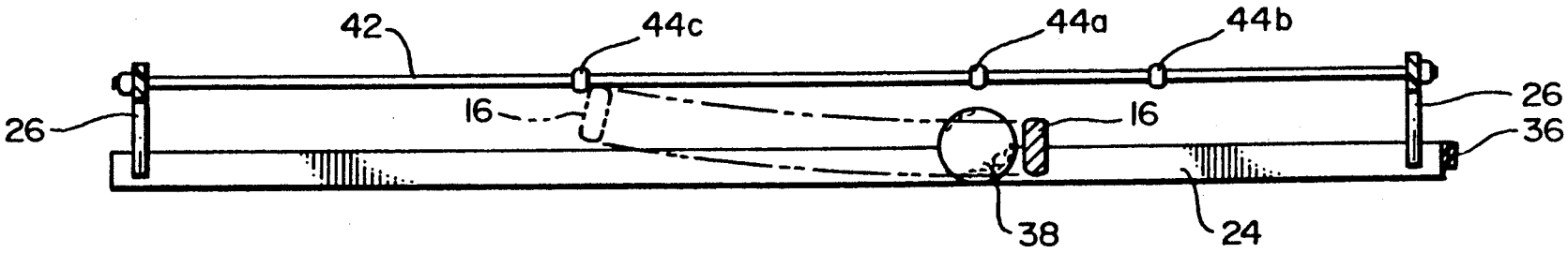
FIG. 9 is a side elevational view, illustrating the pendulum swing of the head of a golf putter, relative to the locating string.

Step 7: The next step is to move the club in a pendulum swing such that the putter head 16 moves through an arc that does not carry the putter head 16 too far above the putting surface. This is illustrated in FIG. 9, showing the club head 16 moving into contact with the ball and then on the follow through swing at a rather moderate upward arc. The cord 42 gives the player the indication when the putter head 16 is being swung too far upwardly, since it will contact the cord 42 if the arc of the swing is too high.

It is to be understood, of course, that the player in using the apparatus 10 will sometimes select certain steps in the teaching sequence to "iron out" irregularities in the putting stroke. For example, the person may continue to concentrate on nothing else but proper alignment of the club head 16 throughout a number of putting strokes. Then the person may concentrate for a while on the movement of the club head 16 to the proper distance on the backstroke (to the bead 44*b*). Further, the person may wish to experiment with different lengths of backstroke and thus move the rear bead 44*b* to different locations.

It has been found that the apparatus 10 not only lends itself to self-teaching, but is also of substantial help to the instructor. For example, as the instructor observes the person's putting stroke, the instructor may make adjustments in the location of the beads and also direct the student to concentrate on different facets. For example, the instructor may see that the student is rather erratic on the follow through. If so, the instructor may tell the student to concentrate on the more forward bead 44*c* on the follow through portion of the stroke.

Another example is that the alignment clips 48 could be shifted moderately to possibly "over-correct" a tendency for the person to misalign the club. Further, if the alignment of the club head 16 becomes a problems at different portion of the stroke, these clips 48 can be moved to other locations. It could happen, for instance, that when the person moves the club to the end of the backstroke, the face of the club becomes angled to a more open position. If so, it may be desirable to move the alignment clips 48 to the location of the back bead 44*b* so that the person can observe the precise cross-alignment of the club head 16 at the furthermost back part of the backstroke.

Also, the alignment cord 42 is provided with inch markers 50 along its length. This gives the user repeatability when using the apparatus 10 on different occasions. For example, the person may desire a backstroke of so many inches, and follow through stroke of so many inches. The next day the person may want to change the relationship of the backstroke to the follow through stroke. The inch markers 50 and the beads 44*a–c* enable this to be done conveniently and accurately.

Figure 6:
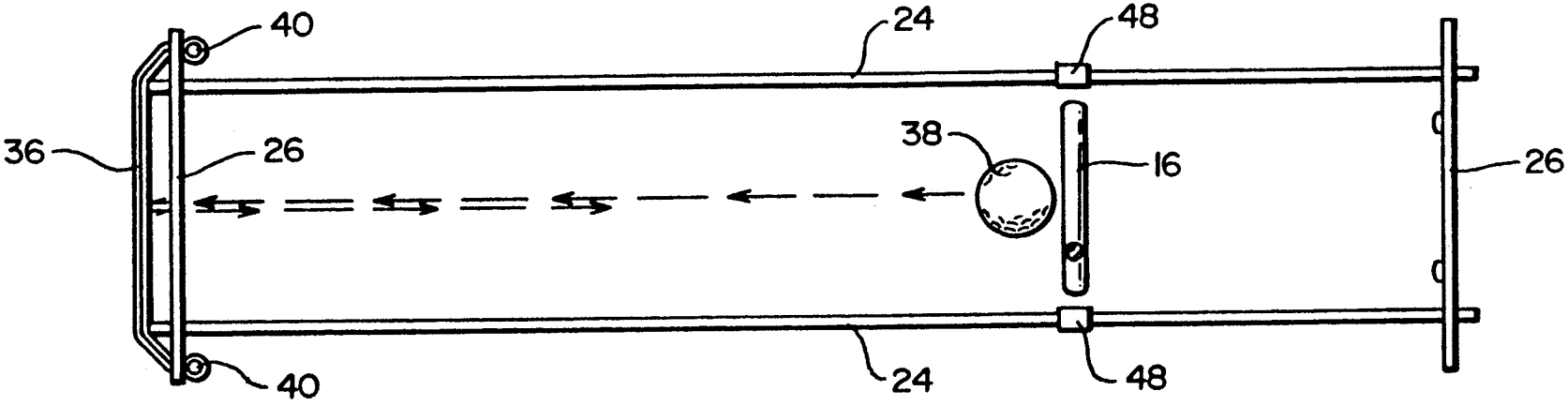
FIGS. 6 and 7 are top plan views of the apparatus showing the execution of the putting stroke, with FIG. 6 illustrating a stroke with true alignment, and FIG. 7 illustrating the stroke with the alignment being slightly angled.
Figure 7:
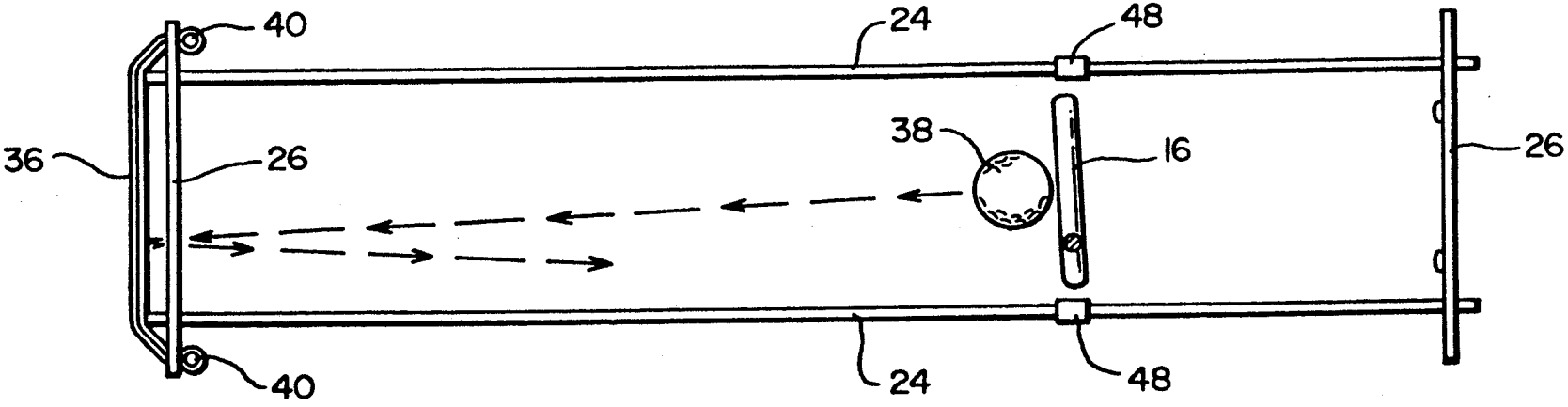
Figure 8:
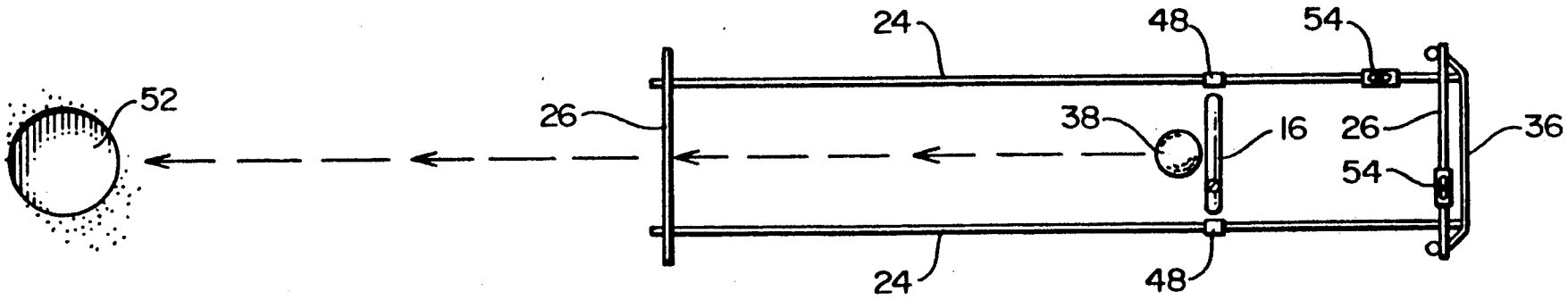
FIG. 8 is a view similar to FIGS. 6 and 7, but showing the apparatus being used without the rebound member and with the golf ball being directed toward the cup on a putting surface.

With regard to the rebound member 36, this is used when the person is simply repeating the putting stroke and does not wish to actually shoot toward a target, such as the hole on the putting surface. Further, the opening 32 is sized so that the rebound from the member 36 will generally be nearly straight back if the golf ball 38 is only moderately off its course. This is illustrated in FIGS. 6 and 7. Also, the direction of the rebound is an indication if the putt is off line.

Another method of using the present invention is putt the ball directly through the end opening 32 which does not have the rebound band 36 so that the ball will carry through toward a putting hole 52 or some other target. The apparatus has a number of advantages when used in this mode. First, it will help the person to gage the length of the putt and set the beads 44*a–c* accordingly for putts of various lengths.

Also the apparatus 10 can be provided with leveling devices 54, in the form of simple bubble levels with markings, and one of these is placed on the upper edge of the end member 26 and another on the upper edge of one of the side rails 24. In the event that the putting surface slopes from the horizontal, the alignment of the apparatus 10 may be changed to compensate for this slope. Since the degree of alignment compensation is also related to the velocity with which the ball is struck, the placing of the locating beads 44*a, b* and *c* (which are as a general rule also related to the velocity of the putting stroke at impact) can be adjusted relative to the alignment of the device 10 to optimize the putting stroke for any particular situation of varying slopes in the putting green.

Figure 10:
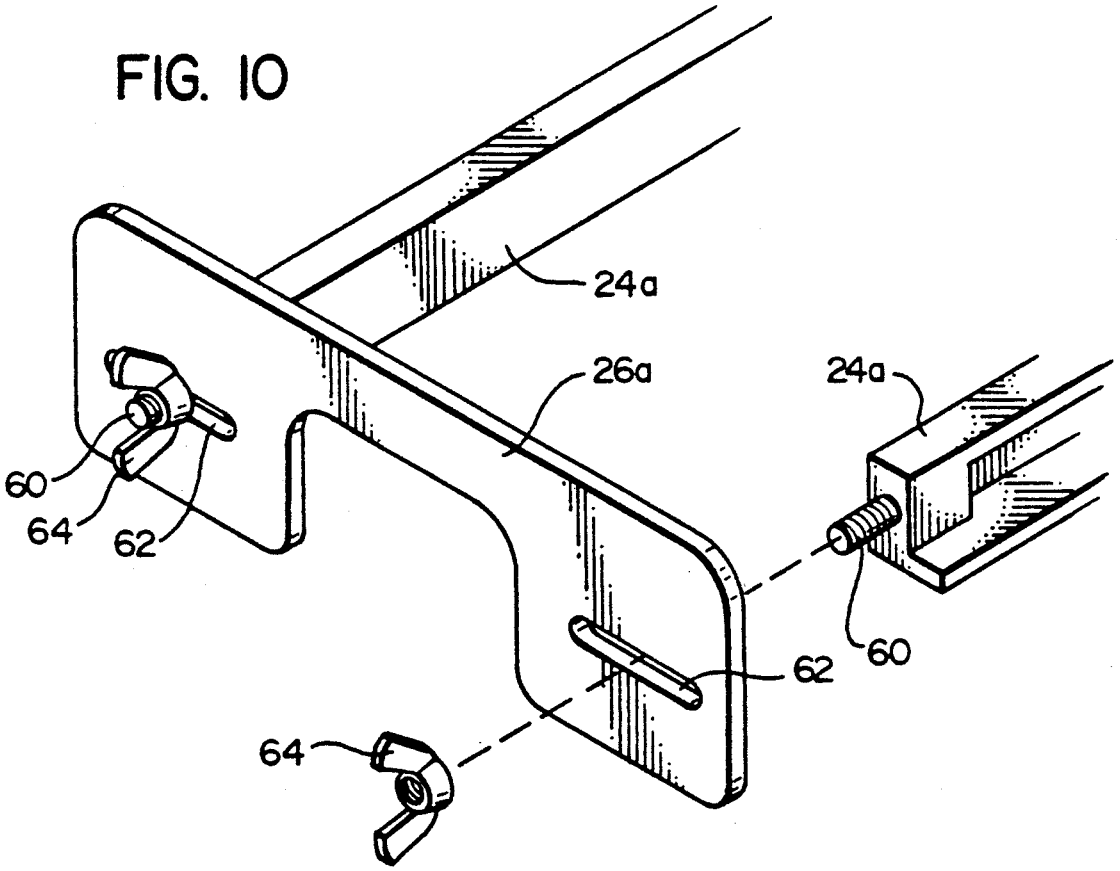
FIG. 10 is an isometric view of a modified connecting means for the rails and the end members.

FIG. 10 shows a modified connecting means for the rails and end sections. The rails 24*a* are provided with end bolts 60 that fit through lateral slots 62 in the end section 26*a*. Wing nuts 64 are used to hold the end section 26*a* to the rails 24*a* at the desired location.

What is claimed is:

1. A golf putting improvement and/or teaching apparatus, comprising:

a. a frame which has a longitudinal axis and is adapted to be positioned on a putting surface, said frame having parallel side rails extending along said longitudinal axis and end members defining a putting area in which can be positioned a head of a putter and a golf ball, with the side rails defining a putting path and being spaced from one another a sufficient distance to permit said putter to be moved longitudinally between said rails in a putting stroke;

b. a rebound member positioned at one end portion of said frame in transverse alignment with the putting path defined by the frame so as to rebound a ball traveling on said putting path back along said putting path; and c. a locating means extending along said path, said locating means being provided with at least two moveable locating members which can be selectively positioned at two longitudinally spaced locations along said longitudinal axis to identify stroke locations.

2. The apparatus as recited in claim 1, wherein there is a third moveable locating member which can be selectively positioned at a third location spaced longitudinally from said two locations, whereby a third stroke location can be identified on said path.

3. The apparatus as recited in claim 1, wherein said locating means comprises an elongate mounting member extending along said path, and said locating members are mounted to said mounting member for movement longitudinally along said mounting member to various longitudinal locations.

4. The apparatus as recited in claim 3, wherein said mounting member comprises a cord means extending between said two end members, and located between said side rails above said putting path, and said locating members are moveable along said cord means.

5. The apparatus as recited in claim 4, wherein said locating members are each a bead means moveably mounted to said cord.

6. The apparatus as recited in claim 1, wherein there is leveling means mounted on said frame to provide a transverse slope leveling orientation and a longitudinal slope leveling orientation for said frame relative to said putting surface.

7. A golf putting improvement and/or teaching apparatus, comprising:

a. a frame which has a longitudinal axis and is adapted to be positioned on a putting surface, said frame having parallel side rails extending along said longitudinal axis and end members defining a putting area in which can be positioned a head of a putter and a golf ball, with the side rails defining a putting path and being spaced from one another a sufficient distance to permit said putter to be moved longitudinally between said rails in a putting stroke;

b. a rebound member positioned at one end portion of said frame in transverse alignment with the putting path defined by the frame so as to rebound a ball traveling on said putting path back along said putting path; and c. at least one of said end members having a through opening, and said rebound member being removably positioned in alignment with said through opening, whereby the ball moving in the putting area can, with the rebound member removed, pass through the through opening or, with the rebound member in place be rebounded from the through opening.

8. The apparatus as recited in claim 7, wherein said rebound member comprises a flexible band member extending across said through opening.

9. A golf putting improvement and/or teaching apparatus, comprising:

a. a frame which has a longitudinal axis and is adapted to be positioned on a putting surface, said frame having parallel side rails extending along said longitudinal axis and end members defining a putting area in which can be positioned a head of a putter and a golf ball, with the side rails defining a putting path and being spaced from one another a sufficient distance to permit said putter to be moved longitudinally between said rails in a putting stroke;

b. a rebound member positioned at one end portion of said frame in transverse alignment with the putting path defined by the frame so as to rebound a ball traveling on said putting path back along said putting path; and c. said end member at the other end of said frame is provided with an unobstructed through opening, whereby the ball can be putted along said path through said unobstructed through opening in one direction, or can be putted along a opposite path toward the end member to be rebounded thereby.

10. A golf putting improvement and/or teaching apparatus, comprising:

a. a frame which has a longitudinal axis and is adapted to be positioned on a putting surface, said frame having parallel side rails extending along said longitudinal axis and end members defining a putting area in which can be positioned a head of a putter and a golf ball, with the side rails defining a putting path and being spaced from one another a sufficient distance to permit said putter to be moved longitudinally between said rails in a putting stroke;

b. a rebound member positioned at one end portion of said frame in transverse alignment with the putting path defined by the frame so as to rebound a ball traveling on said putting path back along said putting path; and c. a pair of alignment members, each mounted to a respective rail member, said alignment members being moveable longitudinally along said rail members so as to provide visible alignment references at selected locations along said longitudinal access.

11. The apparatus as recited in claim 10, wherein said alignment members comprise a pair of clip means mounted to said rail members and independently moveable along said rail members.

12. The apparatus as recited in claim 10, further comprising a locating means extending along said path, said locating means being provided with at least two moveable locating members which can be selectively positioned at two longitudinally spaced locations along said longitudinal axis to identify stroke locations.

13. The apparatus as recited in claim 12, wherein there is a third moveable locating member which can be selectively positioned at a third location spaced longitudinally from said two locations, whereby a third stroke location can be identified on said path.

14. A golf putting improvement and/or teaching apparatus, comprising:

a frame which has a longitudinal axis and is adapted to be positioned on a putting surface, said frame having parallel side rails extending along said longitudinal axis and end members defining a putting area in which can be positioned a head of a putter and a golf ball, with the side rails defining a putting path and being spaced from one another a sufficient distance to permit said putter to be moved longitudinally between said rails in a putting stroke;

b. a rebound member positioned at one end portion of said frame in transverse alignment with the putting path defined by the frame so as to rebound a ball traveling on said putting path back along said putting path; and c. at least one of said end members having a through opening, and said rebound member being removably positioned in alignment with said through opening, whereby the ball moving in the putting area can, with the rebound member removed, pass through the through opening or with the rebound member in place, be rebounded from the through opening;

d. a locating means extending along said path, said locating means being provided with at least two moveable locating members which can be selectively positioned at two longitudinally spaced locations along said longitudinal axis to identify stroke locations;

e. a third moveable locating member, which can be selectively positioned at a third location spaced longitudinally from said two locations, whereby a third stroke location can be identified on said path; and f. a pair of alignment members, each mounted to a respective rail member, said alignment members being moveable longitudinally along said rail members so as to provide a visible alignment reference at selected locations along said longitudinal axis.

15. A golf putting improvement and/or teaching apparatus, comprising:

a. a frame having a longitudinal axis and adapted to be positioned on a putting surface and having side rails and end members defining a putting area in which can be positioned a head of a putter and a golf ball, with the side rails defining a putting path;

b. a locating means extending along said path, said locating means being provided with at least two moveable locating members which can be selectively positioned at two longitudinally spaced locations along said longitudinal axis to identify stroke locations.

16. The apparatus as recited in claim 15, wherein there is a third moveable locating member which can be selectively positioned at a third location spaced longitudinally from said two locations, whereby a third stroke location can be identified on said path.

17. The apparatus as recited in claim 15, wherein said locating means comprises an elongate mounting member extending along said path, and said locating members are mounted to said mounting member for movement longitudinally along said mounting member to various longitudinal locations.

18. The apparatus as recited in claim 17, wherein said mounting member comprises a cord means extending between said two end members and located between said side rails above said putting path, and said locating members are moveable along said cord means.

19. The apparatus as recited in claim 18, wherein said locating members are each a bead means moveably mounted to said cord.

20. A method of practicing golf putting comprising:

a. providing a frame having a longitudinal axis and adapted to be positioned on a putting surface, and having side rails and end members defining a putting area in which can be positioned a head of a putter and a golf ball, with the side rails defining a putting path;

b. providing a locating means extending along said path with at least two moveable locating members;

c. selectively positioning said locating members along said longitudinal axis at longitudinally spaced locations to identify two longitudinally spaced stroke locations;

d. practicing a putting stroke by moving a putter through the putting stroke in accordance with the positioning of the locating members.

21. The method as recited in claim 20, wherein there is a third moveable locating member, and one locating member is positioned at a rear stroke location, another locating member is positioned at a forward stroke location, and the third locating member is placed at an intermediate stroke location at the position of the golf ball, and the putting stroke is practiced relative to said locating members.

22. The method as recited in claim 21, wherein said locating means comprises an elongate member extending between said two end members and located between said side rails above said putting path, and said locating members are positioned at longitudinally spaced locations above said putting path in a manner that a person is able to look downwardly on said locating members being vertically aligned with a head of said putter or said golf ball.

23. The method as recited in claim 22, wherein there are provided on each side rail a longitudinally moveable clip means, said method further comprising aligning said clip means at an initial club head location and then aligning said club head with said clip means.

24. The method as recited in claim 20, wherein there are provided on each side rail a longitudinally moveable clip means, said method further comprising aligning said clip means at an initial club head location and then aligning said club head with said clip means.

* * * * *